US008704173B2

(12) United States Patent
Nikolaev et al.

(10) Patent No.: US 8,704,173 B2
(45) Date of Patent: Apr. 22, 2014

(54) ION CYCLOTRON RESONANCE MEASURING CELLS WITH HARMONIC TRAPPING POTENTIAL

(75) Inventors: Evgenij Nikolaev, Moscow (RU); Ivan Boldin, Moscow (RU); Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 13/499,817

(22) PCT Filed: Sep. 17, 2010

(86) PCT No.: PCT/EP2010/063698

§ 371 (c)(1),
(2), (4) Date: Apr. 2, 2012

(87) PCT Pub. No.: WO2011/045144

PCT Pub. Date: Apr. 21, 2011

(65) Prior Publication Data

US 2012/0193529 A1 Aug. 2, 2012

(30) Foreign Application Priority Data

Oct. 14, 2009 (DE) ..... 10 2009 050 039
Oct. 16, 2009 (DE) ..... 10 2009 049 590

(51) Int. Cl.
*H01J 49/20* (2006.01)
*H01J 49/26* (2006.01)
*H01J 49/28* (2006.01)

(52) U.S. Cl.
USPC ..... 250/291; 250/290

(58) Field of Classification Search
USPC ..... 250/290, 291
See application file for complete search history.

(56) References Cited

U.S. PATENT DOCUMENTS

| | | | | |
|---|---|---|---|---|
| 4,818,864 | A * | 4/1989 | Allemann | 250/291 |
| 4,931,640 | A * | 6/1990 | Marshall et al. | 250/291 |
| 2004/0245455 | A1 * | 12/2004 | Reinhold | 250/288 |
| 2006/0226357 | A1 * | 10/2006 | Franzen et al. | 250/307 |
| 2007/0278402 | A1 * | 12/2007 | Zubarev et al. | 250/291 |
| 2008/0277577 | A1 | 11/2008 | Funsten | |
| 2008/0296490 | A1 * | 12/2008 | Hidalgo et al. | 250/287 |
| 2009/0008544 | A1 * | 1/2009 | Ryjkov | 250/282 |
| 2009/0073135 | A1 * | 3/2009 | Lin et al. | 345/173 |
| 2010/0207020 | A1 | 8/2010 | Jertz | |

OTHER PUBLICATIONS

Tolmachev et al: "Trapped-Ion Cell with Improved DC Potential Harmonicity for FT-ICR MS", Journal of the American Society for Mass Spectrometry, Elsevier Science Inc, US, vol. 19, No. 4, Jan. 31, 2008, pp. 586-597.

* cited by examiner

*Primary Examiner* — Jack Berman
*Assistant Examiner* — Kevin Chung
(74) *Attorney, Agent, or Firm* — Robic, LLP

(57) ABSTRACT

Devices and methods for the acquisition of mass spectra with very high mass resolution in ion cyclotron resonance mass spectrometers include cylindrical ICR measuring cells with special electrode geometries to generate harmonic trapping potentials for orbiting ions. The sheath of the cylindrical cell is divided by longitudinal gaps into a multitude of sheath electrodes, which either have to carry layers with resistance profiles able to generate parabolic voltage profiles along the sheath electrodes, or which form sheath electrodes of varying width by parabolic gaps. Orbiting ions of a given mass m/z oscillate harmonically in an axial direction with the same frequency, independent of the radius of their orbit and their oscillation amplitude. Ideally, the cylinders are closed by endcaps with rotationally hyperbolic form, divided into partial electrodes. The ions are excited by dipolar excitation fields. The orbiting ion clouds are kept together for much longer periods than was possible hitherto.

15 Claims, 6 Drawing Sheets

Figure 14
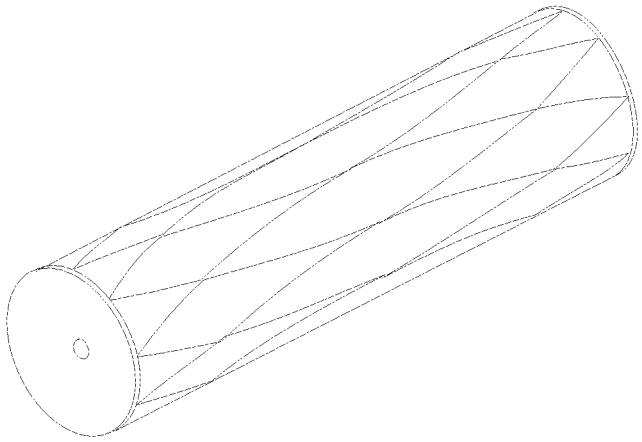
Figure 15
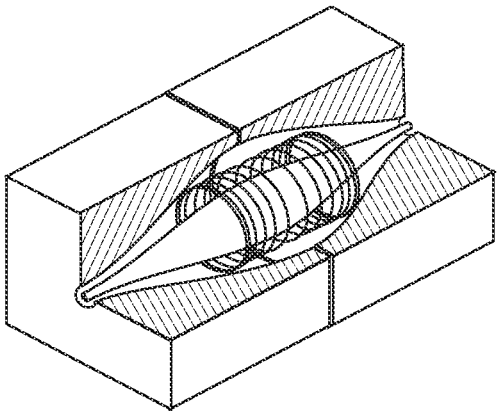
Figure 16 (Prior Art)
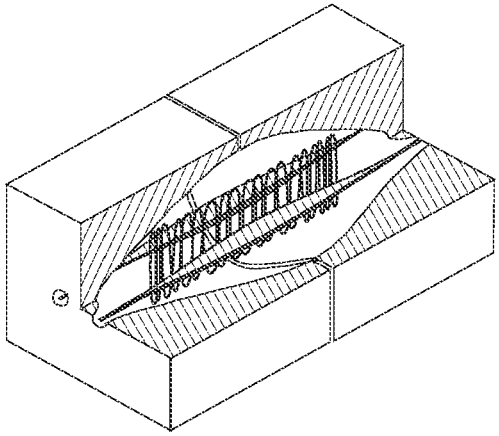
Figure 17 (Prior Art)

ION CYCLOTRON RESONANCE MEASURING CELLS WITH HARMONIC TRAPPING POTENTIAL

FIELD OF INVENTION

The invention relates to devices and methods for the acquisition of mass spectra with ultrahigh mass resolution in ion cyclotron resonance and oscillation mass spectrometers.

PRIOR ART

In ion cyclotron resonance mass spectrometers (ICR-MS), the charge-related masses m/z of the ions are measured by means of the frequencies of the orbital motions of clouds of coherently flying ions in ICR measuring cells, also called "Penning ion traps", which are positioned in a homogenous magnetic field of high field strength. The orbital motion normally consists of superpositions of cyclotron and magnetron motions, the magnetron motions slightly distorting the measurement of the cyclotron frequencies. The magnetic field is generated by superconducting magnet coils cooled with liquid helium. Nowadays, commercial mass spectrometers provide usable ICR measuring cells with internal diameters of up to approximately 6 centimeters in magnetic fields of 7 to 18 tesla.

Figure 1:
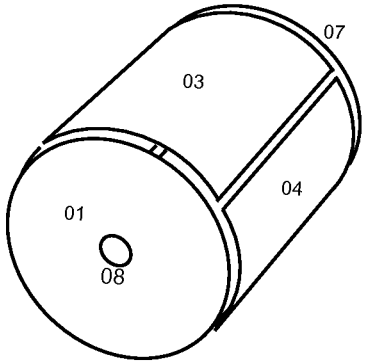
Figure 1 (Prior Art)

In the ICR measuring cells, ICR cells in short, the orbital frequency of the ions is measured in the most homogenous part of the magnetic field. Cylindrical measuring cells with circular cross-section are usually used. According to prior art, the ICR cells usually comprise four longitudinal electrodes having a constant width along the measuring cell, extending parallel to the magnetic field lines and surrounding the inside of the measuring cell like a cylinder sheath, as shown in FIG. 1. Conventionally, an AC voltage pulse is applied to two opposing longitudinal electrodes in order to excite ions injected close to the axis to larger orbits of their cyclotron motion; ions having the same charge-related mass m/z are excited as coherently as possible and orbit after excitation in phase as a cloud. The two other longitudinal electrodes serve to measure the orbiting of the ion clouds by their image currents, which are induced in the electrodes as the ion clouds fly past. Filling the ions into the measuring cell, ion excitation and ion detection are carried out in successive phases of the method, as is known to anyone skilled in the art.

Since the mass-to-charge ratio m/z of the mass m to the number z of elementary charges of the ions (simply called "charge-related mass" below, in most cases simply "mass") is not known before the measurement, the ions are excited by a mixture of excitation frequencies which is as homogeneous in frequencies as possible. This mixture can be a time-sequential mixture with frequencies increasing with time (this is then called a "chirp"), or it can be a synchronous, computer-calculated mixture of all frequencies (a "sync pulse"). Chirps are most common.

The image currents induced in the detection electrodes by the orbiting ion clouds form a so-called "transient" as a function of time. The transient is a "time domain signal" and usually decays within a few seconds to such an extent that only noise remains. In measuring cells of conventional design, the length of the usable transient is only around a few seconds. Where the term "duration" of a transient is used below, this term shall always mean the "usable duration".

The image currents of the transients are amplified, digitized and analyzed by Fourier analysis for the orbital frequencies of the ion clouds of different masses present therein. The Fourier analysis transforms the sequence of the original image current measurements of the transient from a "time domain" into a sequence of frequency values in a "frequency domain". The frequency signals (frequency position and signal amplitude) of the different ion species, which can be recognized as peaks in the frequency domain, are then used to determine their charge-related masses m/z and their intensities. This kind of indirect mass spectrum acquisition is therefore called "Fourier transform mass spectrometry" (FTMS).

It must be noted here that today there exist also other types of FTMS mass spectrometer, which are not based on the orbiting of ions in magnetic fields. In these other types of FTMS mass spectrometers, ions oscillate in a parabolic potential well, and the image currents induced in suitable detection electrodes are used to determine the mass of the ions, similar to ICR. These types of mass spectrometers may be called "oscillation mass spectrometers".

Best known is the Kingdon type electrostatic ion cell of the "Orbitrap®" of ThermoFisher Scientific, Bremen, exhibited in FIG. 16. U.S. Pat. No. 5,886,346 (A. A. Makarov) elucidates the fundamentals of this special Kingdon ion trap. The Orbitrap® consists of a single, spindle-shaped inner electrode and coaxial housing electrodes transversely split down the center, the housing electrodes having an ion-repelling electric potential and the inner electrode an ion-attracting electric potential. Electrostatic ion cells of the Kingdon type do not require a magnetic field. Ions cycle around an inner electrode, and at the same time, oscillate harmonically in axial direction. The oscillation in axial direction is measured.

DE 10 2007 024 858.1 (C. Köster) describes further types of Kingdon ion trap which have more than one inner electrode. An example is presented in FIG. 17. Here too, the inner electrodes and the outer housing electrodes can be precisely formed in such a way that the longitudinal motion is completely decoupled from the transverse motion and a parabolic potential well is created in the longitudinal direction to generate a harmonic oscillation. These oscillation mass spectrometers are almost as good as ICR instruments with respect to mass resolutions and mass accuracies. They are advantageous in the higher mass range because the mass resolution drops only to higher masses m/z reciprocally with the square root of the mass, not reciprocally to the mass m/z itself as ICR instruments.

When the term "acquisition of a mass spectrum" or a similar phrase is used below in connection with ICR or oscillation mass spectrometers, this includes, as is known to anyone skilled in the art, the entire sequence of steps from the filling of the ICR cell with ions, excitation of the ions to cyclotron orbits or axial oscillations, measurement of the image current transient, digitization, Fourier transform, determination of the frequencies of the individual ion species, and finally calculation of the charge-related masses and intensities of the ion species which represent the mass spectrum.

In ICR mass spectrometers, it is possible to achieve an extraordinarily good accuracy for the mass determination, owing to the high constancy of the magnetic fields and the high measuring accuracy for frequency measurements. Fourier transform ICR mass spectrometry (abbreviated correctly FT-ICR-MS) is currently the most accurate of all types of mass spectrometry. The accuracy of the mass determination essentially depends on the number of ion cycles which can be detected by the measurement, and therefore on the usable duration of the transient.

There are various methods for introducing the ions into the ICR measuring cell and, in particular, for trapping them, such as the "side-kick" method or the method of dynamic trapping with an increase of the trapping potential, but they are not discussed here further. Those skilled in the art are aware of these methods.

Exact mass determination is of immense importance in modern biological mass spectrometry (i.e., mass spectrometric analyses of molecules generated in plants, animals or humans). No limit for the mass accuracy is known beyond which no further increase in useful information content could be expected. Increasing the mass accuracy is therefore a goal which will continue to be pursued. A high mass accuracy alone is often not sufficient to solve a given analytical task, however. In addition to high mass accuracy, a high mass resolving power is often crucial because in biological mass spectrometry, in particular, frequently ion signals with very slight mass differences must be detected and measured separately. In enzymatic digestion of protein mixtures, for example, there are thousands of ions in a mass spectrum; several different ion species with tiny mass differences of a few millidaltons must often be separated and precisely measured, the mass difference given, e.g., by the difference between $^{16}O^{18}O$ and $^{34}S$ (≈16 millidalton) inside a big molecule. In the analysis of crude oil, quite often several hundred ion species have to be measured separately at a single nominal mass.

In the cylindrical measuring cells with circular cross-section which have been used until now, the cylinder is usually formed by four longitudinal sheath electrodes, as depicted in FIG. 1. The main reasons for circular cylindrical measuring cells are their best utilization of the volume of the magnetic field in a round coil, the best excitation of the extended ion clouds by extended dipolar fields, and the best detection of the image currents by likewise extended detection electrodes.

Figure 2:
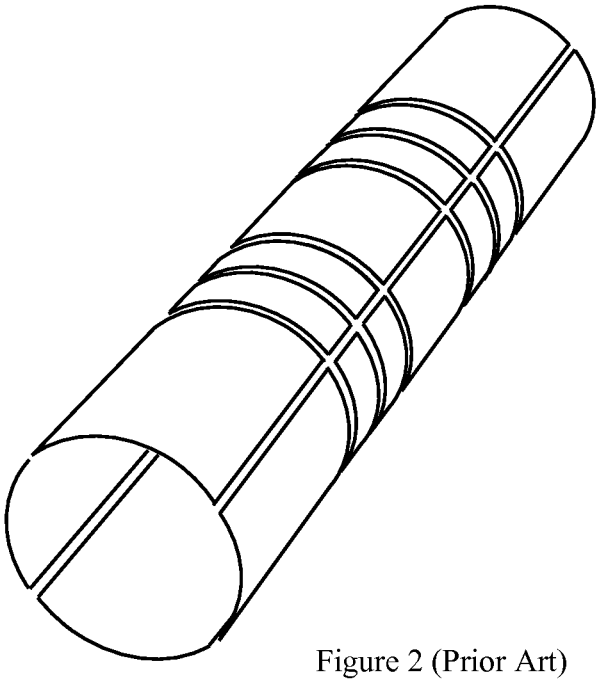
Figure 2 (Prior Art)

The ions, however, are not trapped completely in the cylindrical ICR cell, because they can move freely in the direction of the magnetic field lines. As a result of the filling process, the ions possess velocity components in the direction of the magnetic field. Consequently, they must be prevented from leaving the ICR cell. The ICR cells are therefore equipped at both ends with electrodes, known as "trapping electrodes". These are usually supplied with ion-repelling DC potentials in order to keep the ions within the ICR cell. There are very different shapes for this electrode pair; the simplest design uses planar electrodes (1) and (7) with a central aperture (8), as can be seen in FIG. 1. The apertures (8) serve to introduce the ions axially into the measuring cell. In other cases, further electrodes in the form of cylindrical sheath segments are mounted outside the inner measuring cell, as shown in FIG. 2; these continue the inner cylinder sheath segments outwards and are supplied with trapping voltages. This creates an open cylinder without end walls; these cells are called "open ICR cells". Open cells are used to axially prolong the extended dipole field for an undisturbed excitation of the axially extended ion cloud.

If one considers only the potential profile within the axis of the measuring cell, the ion-repelling potentials of the outer trapping electrodes (measured with reference to the potential of the sheath electrodes) generate a potential well in the interior of the measuring cell, both for apertured diaphragms and for open ICR cells. The potential profile along the axis has a minimum at precisely the mid-point of the measuring cell if the ion-repelling potentials on the trapping electrodes at both ends have the same value, with a harmonic potential distribution in the direct, close vicinity of the center. The harmonic potential distribution, governed by the Laplace equations, exhibits a parabolic potential well in the axial direction as well as a parabolic potential hill in any transverse direction. Further away from the center, the potential profiles deviate increasingly from the parabolic profiles. The ions introduced will execute oscillations in the axial potential well, known as trapping oscillations, because they still possess velocities in the axial direction resulting from their introduction. As long as no kinetic energy in the axial direction is fed to the ions, the strong magnetic field keeps the ions on the ICR cell axis and prevents any radial evasion.

We now consider ion clouds excited by dipolar excitation AC pulses to ion cyclotron motions. The trapping potentials, which are the basis of the trapping oscillations, affect the orbital frequencies of the ions due to the radial electric field components, and thus affect the mass determination. In the absence of additional space charge effects, i.e. when only a few ions are present in the ICR measuring cell, the measured orbital frequency ω− (the "reduced cyclotron frequency") of an ion species amounts to $$\omega_+ = \frac{\omega_c}{2} + \sqrt{\frac{\omega_c^2}{4} - \frac{\omega_t^2}{2}},$$

where $\omega_c$ is the unperturbed cyclotron frequency, and $\omega_t$ the frequency of the trapping oscillation. It can be seen from this that it is advantageous to create a harmonic electric trapping potential for the trapping oscillations with a potential distribution which is still exactly harmonic even far away from the center, because only then the frequency $\omega_t$ of the trapping oscillation, and thus the measured orbital frequency $\omega_+$, does become independent of the radius of the cyclotron orbit and independent of the axial oscillation amplitude, thus not showing any spread even for ions with some spread of their kinetic energy. It is therefore advantageous to have an exactly quadrupolar potential distribution even far from the center in axial and radial direction. Only with a frequency $\omega_t$, which is independent of its oscillation amplitude and its orbiting radius, there is no spread of the reduced cyclotron frequency ω+ and it can be expected that the charge-related mass m/z derived from this has a high accuracy and high resolution. In addition, it is advantageous to only use very small trapping potentials in order to also keep the frequency $\omega_t$ small. Usually only trapping voltages of up to about three volts are usually used, which requires the introduction of ions with low kinetic energy and low energy spread, however.

The orbital frequencies of the clouds with the respective ion species can be determined by using the Fourier transforms of the image current transients. The longer the image currents can be measured, the more accurately the frequency can be determined. The measuring times for the cyclotron orbits of the ions are limited, however; in commercial ICR mass spectrometers, they often amount to only about four seconds. During this time the amplitude of the image currents of the transient in the time domain has usually decreased so much that the noise dominates and prolonging the measuring time produces no improvement to the frequency determination. The mass resolution is thus not improved any more either.

In order to obtain useful transients over long measuring times, the clouds of coherently flying ions must be kept together for as long as possible. To start with, this requires the best possible vacuum in the measuring cell because the ions must not collide with molecules of residual gas during the measurement of the image currents. Each collision of an ion with a molecule of residual gas brings the ion out of the orbiting phase of the remaining ions with the same charge-related mass. Very high resolving powers require vacua in the region of $10^{-8}$ to $10^{-9}$ pascal.

There are also other phenomena which break up the coherence of the ions, however. In the paper by E. N. Nikolaev et al., "Realistic modeling of ion cloud motion in a Fourier transform ion cyclotron resonance cell by use of a particle-in-cell approach" (*Rapid Commun. Mass Spectrom.* 2007, 21, 1-20), the authors were able to show in complex computer simulations that even in ideal vacua the initially cigar-shaped clouds of ions of the same charge-related mass undergo a continuous change of shape during their orbiting. In ICR cells with trapping by apertured diaphragms at the ends, the cigar-shaped clouds form tails, either from the ends or from the center of the cloud, depending on the conditions; these tails are dragged along on the circular orbit of the clouds. Tails from the center initially generate a shape which resembles broad tadpoles. The tails continuously increase in length until they become continuous enclosing rings which can no longer contribute anything to the detection of frequencies by the image currents. The tadpole heads become simply thickenings of the annular orbiting ion clouds and slowly vanish completely. The usable measuring time has now finished, because the image currents no longer contain any AC current components, which alone can be used to determine the frequencies of the cyclotron orbits.

The reasons for this tail formation have not yet been clarified, but are most probably linked to the shape of the trapping potentials in conjunction with the space charge of individual ion clouds. In the ion clouds, strongly repulsive forces prevail, which try to push the cloud apart. In the strong magnetic field these forces cause the cloud to rotate about its own axis; the gyration adjusts itself in such a way that the force of the repulsive space charge, the additional centrifugal force and the Lorentz force are in balance. Density fluctuations or other effects can lead to imbalances with protuberances. Interestingly it causes hardly any negative effect that the different clouds of ions of different masses continuously overtake each other on their circular orbit, and therefore must repeatedly penetrate each other.

For ion clouds which differ only very little in ion mass and contain large number of ions, this independence of orbiting is no longer true. When very high numbers of ions are present in the ion clouds, ion clouds of very similar masses can coalesce in their cyclotron track, resulting in "peak coalescence". Following excitation, the clouds of ions of different masses with different cyclotron frequencies orbit around the same cycling track. Ion clouds with almost the same cyclotron frequencies (almost identical masses) thus remain near to each other on this track for relatively long periods of time. They only pass each other very slowly and the repelling electrostatic forces between the two clouds act for a very long time. Under the influence of the repelling electrical field, the two gyrating clouds approaching each other begin to rotate around the centroid of their common charge. The cyclotron circulation and this rotation together create cycloidal paths; due to their slightly different cyclotron motion speed, the two clouds are repeatedly brought together again. They may lock to one another in this way. The effect depends on the strength of the repulsion between the ion clouds, that is on the number of ions in the two (or more) ion clouds. In this way, the two ion clouds finally behave as one unit on the cyclotron track, causing a single image signal instead of two separate signals. Thus two (or even more) ICR signals coalesce to a single, often very sharply defined signal. This explanation of peak coalescence, however, is not really conclusive, since peak coalescence also occurs in mass spectrometers without magnetic fields. An example for this is a multi-path time-of-flight mass spectrometer, where ion clouds are reflected several times by 180° and clouds of ions with almost the same mass stay together for a long time in the ion reflector.

In rare cases of extremely strong space charge this peak coalescence involves different signals from one ion species formed by the different $^{13}$C-satellites and which therefore differ by one mass unit. Particularly often, however, it involves the fine structure of these $^{13}$C-satellites with one and the same nominal mass unit, but which also contains some of the isotopes $^{2}$D, $^{15}$N, $^{18}$O or $^{34}$S, and whose signals can only be separated with a particularly high mass resolution. The ion signals from two different substances having the same nominal mass number can also be affected by this. Particularly sharply defined signals produced by peak coalescence can easily be looked upon as high-resolution ICR signals, but they do not contain correct analytical information, and they falsify any precise mass determination.

This peak coalescence usually only occurs when the density of ions is high. Since the clouds of excited ions in the ICR cell have the shape of a thin rotational ellipsoids whose length depends on the trapping potential, the ion density rises if the trapping potential is increased, and coalescence can then occur with a smaller number of ions. It is not known whether peak coalescence also depends on the shape of the ion clouds, the width of the cyclotron tracks or on other parameters.

Most specialists in the field agree that that the trapping potential should have a form which is as close to a three-dimensional quadrupole field as possible, as wide as possible reaching out from the immediate vicinity of the center, in order to allow, for ions of a given mass, trapping oscillations of the same frequency, independent of the oscillation amplitude and of the radius of the cyclotron orbit. Excited ions can then oscillate harmonically parallel to the axis of the measuring cell during their cycling on cyclotron orbits.

Figure 3:
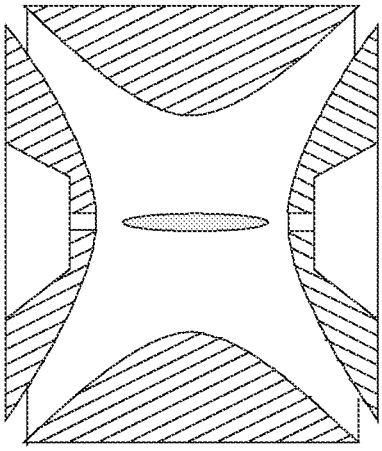
Figure 3 (Prior art)

There is a way of generating such a harmonic quadrupolar trapping field by using rotationally hyperbolic end caps and ring electrodes, as presented in FIG. 3, geometrically the same as those of a three-dimensional Paul RF quadrupole ion trap. But this cell does not allow for a homogeneous excitation of the ion cloud in a dipolar excitation field extended in axial direction, nor does this cell offer a way for high sensitivity ion image current detection, nor does it make best use of the magnetic field.

The design of an ICR measuring cell therefore poses a dilemma: On the one hand, the requirement for a harmonic, quadrupolar distribution of the trapping potentials requires a measuring cell which hitherto can only be produced with rotationally hyperbolic endcap and ring electrodes; on the other hand, uniform excitation of the ions of an extended ion cloud to perform cyclotron motions requires very long electrodes parallel to the axis.

A first approximate solution of this dilemma was presented in the paper by G. Gabrielse et al., "Open-Endcap Penning Traps for High Precision Experiments" (I J Mass Spectrom & Ion Processes, 88 (1989), 319-332). The authors introduced compensation electrodes into an open ICR measuring cell. The open ICR cell design was chosen to generate the extended uniform dipolar field for the excitation of the extended ion cloud. Trapping plates would greatly destroy the uniformity of the dipolar excitation field at both ends of the ICR cell. Measuring cells with five segments were presented, with which good approximations for wide quadrupole trapping fields could be obtained according to mathematical calculations.

There have recently been two further attempts to create trapping potentials in open ICR measuring cells which, in a wide area around the center, reproduce the three-dimensional quadrupole field of an ideal ICR measuring cell as successfully as possible in order to generate harmonic trapping oscillations. These papers also sought to solve the dilemma between hyperbolic and cylindrical measuring cells by using compensation electrodes in cylindrical cells; more compensation electrodes were used than was the case with Gabrielse et al. In both papers the most advantageous potentials at the compensation electrodes were determined by computer simulations. In the paper by A. V. Tolmachev et al., "Trapped-Ion Cell with Improved DC Potential Harmonicity for FT-ICR MS" (J Am Soc Mass Spectrom 2008, 19, 586-597), seven cylinder segments with a total of 28 longitudinal electrodes were used (as shown in FIG. 2); in the paper by A. M. Brustkern et al., "An Electrically Compensated Trap Designed to Eighth Order for FT-ICR Mass Spectrometry" (J Am Soc Mass Spectrom 2008, 19, 1281-1285), nine cylinder segments were used. In the document DE 10 2008 063 233 A1 (R. Jertz and G. Baykut; GB 2 466 551 A), it could be shown, that the potential values obtained by the computer simulations did not result in ideal fields, corrections of the at least three potentials were necessary to achieve transients of maximum usable length. The adjustment, however, is extremely difficult.

It has to be pointed out, that neither the ICR cell by Gabrielse, not ICR cells with more compensation electrodes deliver harmonic potential distributions which reach up to the walls of the cell. In near vicinity to the longitudinal electrodes, necessarily steps of the potential appear in axial direction at the interruptions of the metallic electrodes. The ions cannot be excited up to near the electrodes, only in some distance from the cylinder sheath, the potential distribution approximates the harmonic field. The sensitivity of the cell, however, depends on the distance of the ion orbits to the detection electrodes, and the coherence of the ions clouds seems to react on the slightest deviations from the ideal harmonic field.

Figure 4:
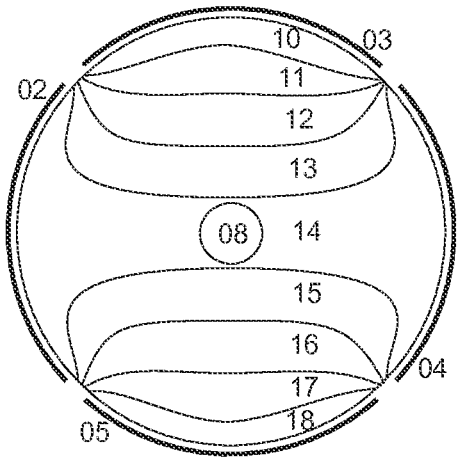
Figure 4 (Prior Art)

As already mentioned, the open cell design was chosen by Gabrielse and the other authors to generate the extended dipolar excitation field. It is, however, possible to generate, inside a closed ICR cell, an extended dipole field reaching uniformly up (almost) to the trapping plates, as described in patent DE 39 14 838 C2 (M. Allemann and P. Caravatti). FIG. 4 exhibits the trapping plates of a so-called "infinity cell", in which the extended dipolar excitation field can be produced. The trapping plates are divided into a multitude of partial electrodes (10) to (18) by complicated gaps, which are formed following selected equipotential surfaces of the dipolar field. If the partial electrodes (10) to (18) are supplied with corresponding partial voltages of the AC excitation voltage, the uniformity of the dipolar field reaches (almost) up to the trapping plates, with only slight deviations near the trapping plates. The dipolar excitation field forms, inside the ICR cell, a section of an infinitely long dipolar excitation field (therefore the name "infinity cell"). The partial AC excitation voltages can be formed by a capacitive voltage divider; the partial electrode (14) does not get any AC voltage. The deviations of the uniformity of the dipolar field near the trapping plate can be reduced by using more partial electrodes.

If the ions of an ion cloud keep together over a long period of time, and the ions run on orbits near the detection electrodes, the measurement time can be shortened for the same resolving power by using more than only two image current measuring detection electrodes. A shorter measuring time is an highly desirable objective. With four or eight measuring electrodes the measured frequency doubles or quadruples relative to the cyclotron frequency, and half or a quarter of the measuring time is sufficient to achieve the same resolving power. If the ion clouds disperse, the usable duration of the transients drops accordingly. The ideal number of measuring electrodes depends very much on the precise way in which the ion clouds disperse.

OBJECTIVE OF THE INVENTION

It is the objective of the invention to provide ICR measuring cells which resolve the dilemma between the generation of an ideal harmonic potential distribution and the excitation of the axially extended ion clouds in an extended dipolar field of good axial uniformity. Methods for measuring cyclotron and axial oscillation frequencies within these cells should be outlined.

SUMMARY OF THE INVENTION

The invention provides ICR measuring cells whose cylindrical surfaces are divided into several long sheath electrodes, preferably reaching from one end of the cell to the other. The sheath electrodes may consist of or carry layers of resistance material in such a way that a parabolic voltage profile is produced from the center to the outside, generating a harmonic field inside, or they may be formed by parabolic gaps in such a way, that the averaged potential, experienced by an ion along any orbit inside the ICR cell, forms such a harmonic field.

In the simplest case, four rectangular sheath electrodes are covered each on the inside with a resistive layer of changing resistance, isolated from the electrode's basic material. A trapping voltage between the ends and the center should show a parabolic increase of the trapping voltage from the center to both ends of the electrodes. Together with two rotationally hyperbolic endcap electrodes at both ends, supplied with the same trapping voltage, a harmonic trapping field is generated which reaches in any direction up to the walls of the ICR cell. Two of the sheath electrodes may be used to excite the ions to cyclotron motion, the other two may be used to measure the image currents induced by these motions. Methods to produce the resistive layers will be elucidated.

If the ICR cell according to this simplest embodiment is long enough, a sufficiently extended dipolar excitation field exists at least in the center of the ICR cell. If the uniformity of this dipolar field in axial direction is not sufficient, the endcap electrodes may be divided into partial electrodes, as in the case of the infinity cell. With trapping endcaps cut into a sufficient number of partial electrodes, also the dipolar excitation field fills the cell up to (almost) the trapping endcaps.

This simple ICR cell design can be altered in many ways. There may be more than only four longitudinal electrodes. Or longitudinal electrodes with resistive layers may be intermixed with longitudinal electrodes without such layers. The well conducting electrodes without resistive layers may serve as detection electrodes to measure the image currents, because this measurement is easily disturbed by resistances catching up or generating electronic noise. In this very interesting case, the potential distribution in the interior of the cell is very complicated, influenced in any point by the voltage on the resistive layers and by the potential on the well conducting electrodes. Orbiting ions, however, experience a potential averaged over their orbits, and this averaged potential is indeed harmonic within the whole ICR cell. During their cyclotron motion on these orbits, however, they experience numerous small potential changes.

The design of the ICR cell according to this invention, however, may be altered still more. The originally rectangular form of the longitudinal electrodes may be changed into arbitrarily chosen forms, making it necessary to adapt the profile of the resistive layers. Interestingly, there are shapes for the longitudinal electrodes, in which no resistive layers at all are required to produce the wanted averaged potential distribution inside the ICR cell. If the longitudinal electrodes are separated from each other by parabolic gaps, and a suitable trapping voltage is supplied, orbiting ions experience a completely harmonic field up to the walls of the ICR cell. The summits of the parabola should lie in the center plane of the ICR cell, vertical to its axis, and the tangents to the summits should be parallel to the axis of the ICR cell.

Supercomputer simulations have shown that the ion clouds orbiting in this ICR cell keep together after excitation much longer than in any potential distribution used hitherto. In first experiments, useful transients measured over minutes instead of seconds were obtained. These measuring cells are ideally suited for the acquisition of mass spectra with extremely high mass resolution. The image currents result in very high-quality transients, from which mass spectra with not only high mass resolution but also maximum mass accuracy can be obtained.

These new ICR cells may not only be used to measure the cyclotron frequencies of the ion clouds. The ion clouds may, after increasing the trapping voltage, also be excited to oscillations in the axial direction, and image currents of these oscillations may be used to determine the masses of the ions. This type of measurement is advantageous for ions of heavy masses because the mass resolution for these oscillation measurements drops favorably only with the reciprocal root of ion mass $1/\sqrt{(m/z)}$ instead of the reciprocal mass z/m, as in the case of ICR.

BRIEF DESCRIPTION OF THE ILLUSTRATIONS

FIG. 1 depicts a cylindrical ICR measuring cell according to the prior art. Between the two trapping endcap electrodes (01) and (07), which here have the form of plane apertured diaphragms, there are four longitudinal sheath electrodes (02) to (05) in the form of parallel sections of the cylindrical surface, of which only two longitudinal electrodes (03) and (04) are visible here. Of the four longitudinal electrodes, two opposing electrodes, (03) and (05) for example, serve to excite the ions to cyclotron orbits and the other two serve to measure the image currents.

FIG. 2 exhibits an open ICR measuring cell in a cylindrical embodiment with a total of seven cylinder segments, also according to the prior art. The four longitudinal electrodes are here each split into seven sections corresponding to the cylinder segments. By applying three trapping voltages to the electrodes of the cylinder segments, a well approximated harmonic trapping potential can be generated, which reaches farer out from the center to the walls than in the cell of FIG. 1, but not up to the sheath electrodes of the cylinder.

FIG. 3 depicts a state-of-the-art ICR cell with rotationally hyperbolic ring and endcap electrodes generating an ideal three-dimensional harmonic DC trapping field. The cell is similar in shape to Paul's RF ion trap. But this trap does not allow to excite the ion cloud by an extended dipolar field, nor does it offer a good way to detect the image currents with high sensitivity. Furthermore, the cell does not make best use of the magnetic field.

FIG. 4 presents a trapping plate of an "infinity cell" according to Allemann and Caravatti, and how the plate is spatially arranged with respect to the four sheath electrodes (02) to (05). The trapping plate is here divided, by gaps of special shapes, into nine partial electrodes (10) to (18). The gaps follow selected equipotential surfaces of the dipolar excitation field in the interior of the ICR cell. If these partial electrodes are supplied, by a capacitive voltage divider, with corresponding partial voltages of the dipolar AC voltage, the dipolar field reaches, with good approximation, uniformly up to the trapping plates. The approximation can be still improved by increasing the number of partial electrodes.

Figure 5:
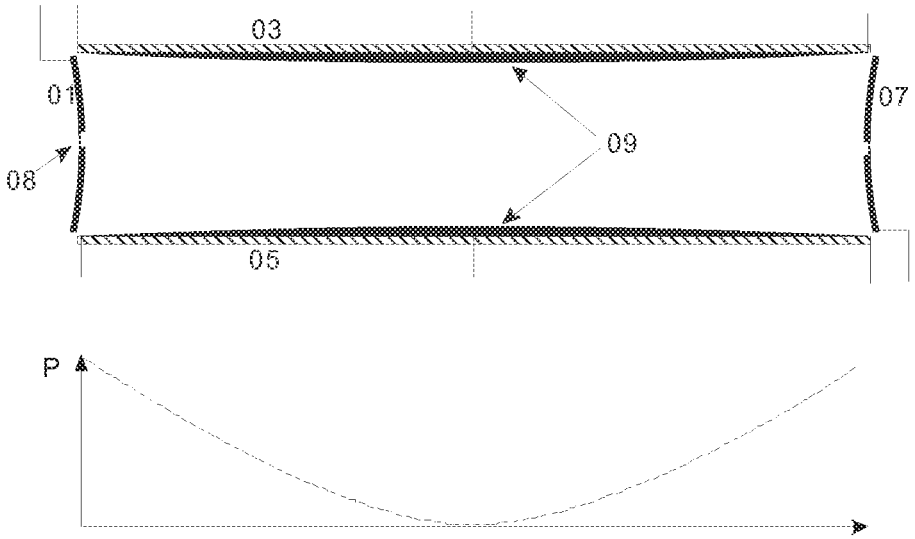

FIG. 5 exhibits schematically in the upper part, how the longitudinal sheath electrodes (03) and (05) of a first embodiment of the ICR cell are covered with layers (09) of a resistive material. The resistances of the layers change from zero resistance in the center to high resistance at the ends; the resistance profile is symbolically indicated by a variation of the thicknesses of the layers (09). The endcap electrodes (01) and (07) are formed as rotational hyperboles, with apertures (08) to introduce the ions. The lower part of this Figure presents the parabolic potential profile P generated by a suitably applied trapping voltage along such a longitudinal electrode.

Figure 6:
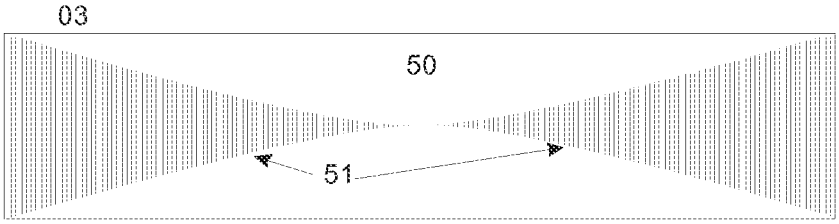

FIG. 6 shows a resistive layer (50) on electrode (03) trimmed by narrow laser cuts (51) into the wanted resistance profile.

Figure 7:
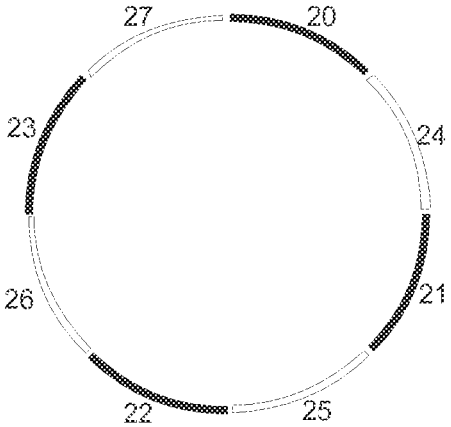

FIG. 7 presents a cross section through a second embodiment of an ICR cell according to this invention, composed by a mixture of four longitudinal electrodes with resistance layers (20) to (23) with four well conducting metal electrodes (24) to (27), the latter serving for image current detection. This ICR cell encloses a complicated potential distribution which is harmonic only on the average for orbiting ions.

Figure 8:
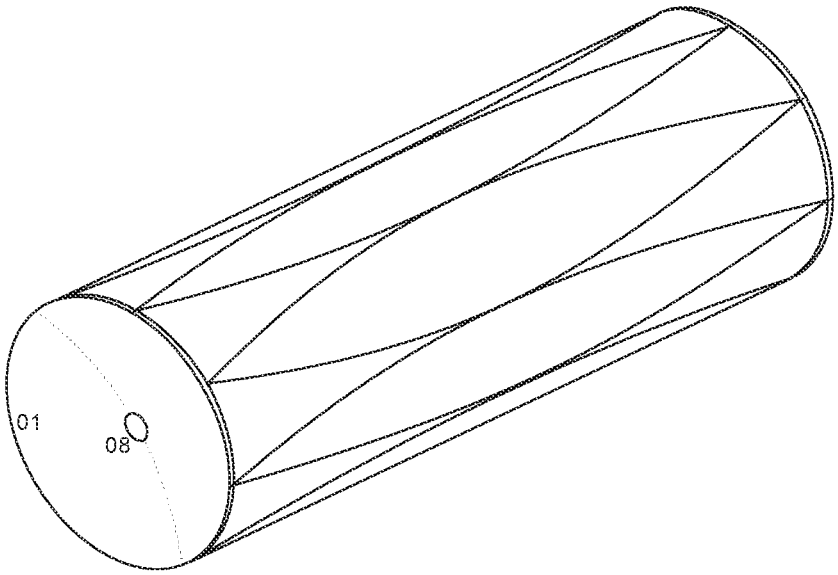

FIG. 8 depicts a most preferred third embodiment of a cylindrical ICR measuring cell with longitudinal electrodes changing in width, not requiring any resistance layer. The sheath electrodes of the cylindrical measuring cell are divided by separating gaps with parabolic shape into eight digon-shaped and sixteen triangular sheath electrodes, each with curved sites. Geometrically, a "digon" is a surface section with two corners, in most cases defined on non-planar surfaces, but here used in combination with curved sites also for plane or cylindrical surfaces. The cylindrical cell is closed at both ends by endcap electrodes (01) which have a rotationally hyperbolic form. Apertures (08) allow for the introduction of ions in the central axis along the magnetic field lines. A single trapping voltage on the triangular sheath electrodes and on the endcaps generates the desired potential distribution in the interior, said potential distribution having a parabolic profile in the axial direction for orbiting ions.

Figure 9:
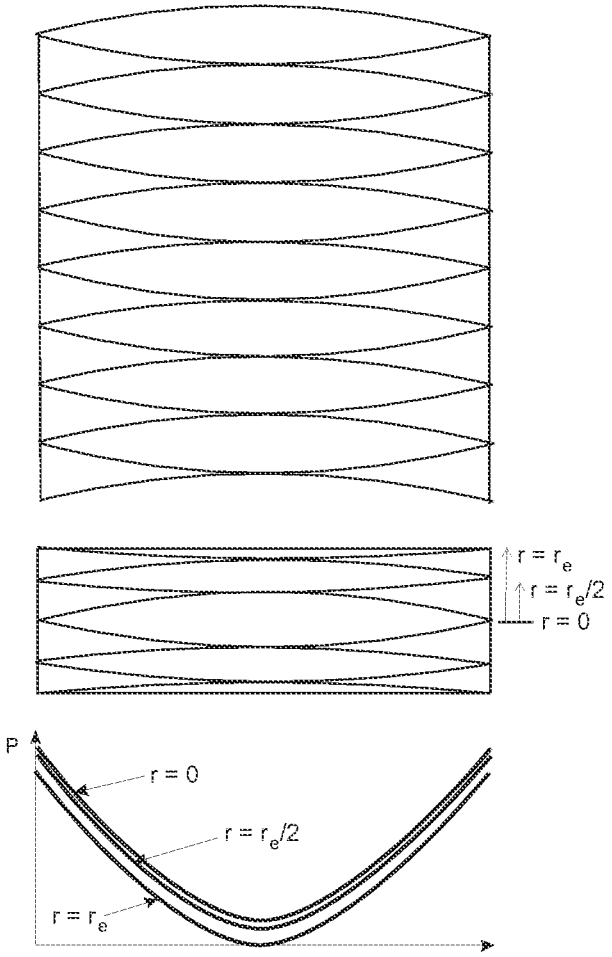

The illustration at the top of FIG. 9 depicts the developed (unrolled) surface of the ICR cell of FIG. 8 with parabolic separating gaps, resulting in eight digonal and sixteen triangular (trigonal) sheath electrodes. The ICR measuring cell is equipped with two endcap electrodes (not visible) at the ends. The illustration in the center of FIG. 9 shows a side view of the measuring cell, defining three different radii. The illustration in the bottom part of FIG. 9 depicts the potential distribution, averaged for ions orbiting with the three radii, which has exactly parabolic potential wells of equal depth for each radius of orbiting, even tightly at the sheath electrodes.

Figure 10:
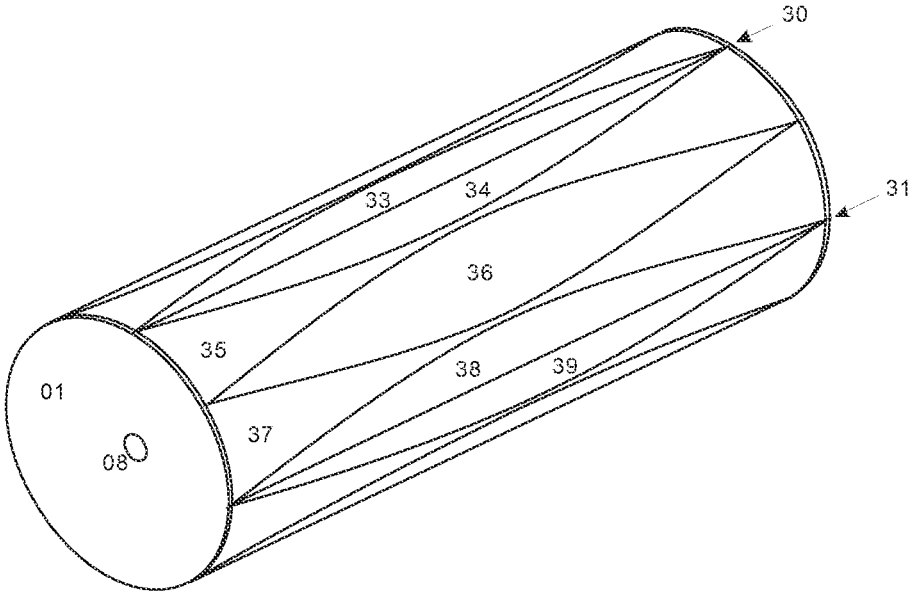

FIG. 10 presents the ICR measuring cell of FIG. 8 in a slightly redesigned form. The digon-shaped electrodes are somewhat narrower, so the sixteen triangular electrodes combine to eight electrodes with slender waists, avoiding field disturbances caused by the sharp corners of the triangular electrodes. Furthermore, four of the digon-shaped electrodes are cut by straight slits (30), (31) into halves (33)/(34) or (38)/(39), allowing to group the longitudinal sheath electrodes into exact quarters of the cylinder sheath, whereby it becomes possible to excite the ions with chirps (or sync-pulses) on whole quarters of the cylinder. This kind of excitation gives, up to now, the best results for long-lasting transients. A quarter, for instance, contains the five longitudinal sheath electrodes (34) to (38).

Figure 11:
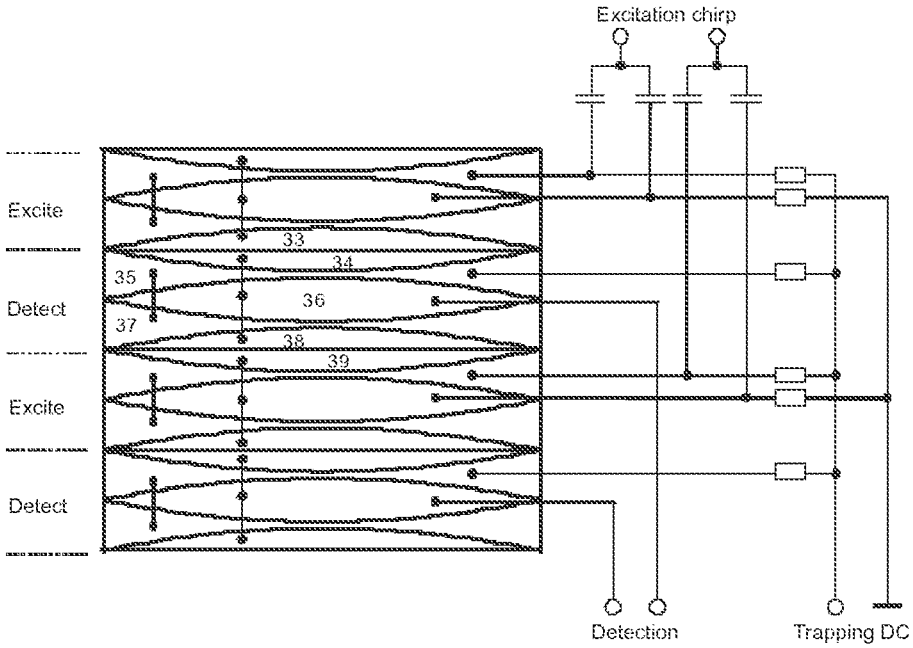

FIG. 11 depicts the wiring of the ICR measuring cell of FIG. 10, showing the application of the trapping DC voltage and the excitation chirp, and the connection to the image current amplifier.

Figure 12:
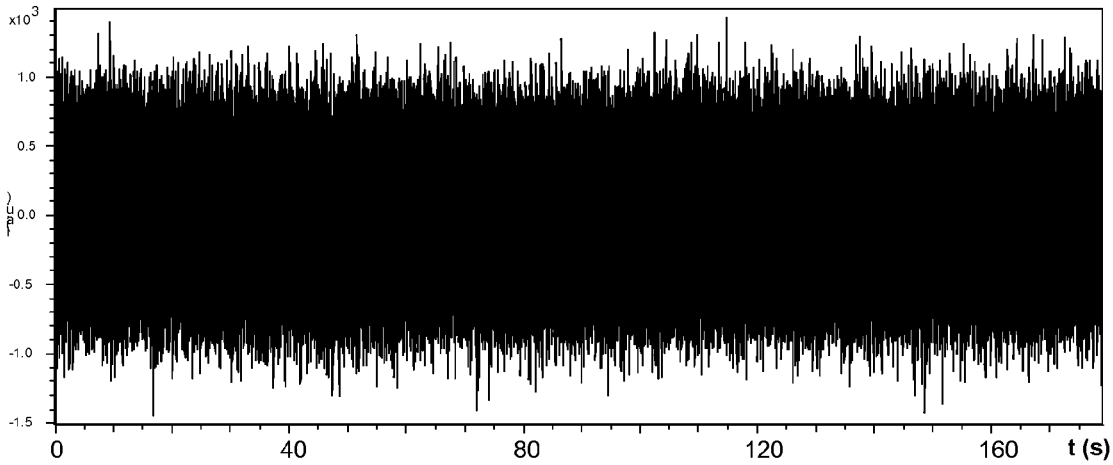

FIG. 12 exhibits the image current transient for the isolated monoisotopic ions of reserpin, demonstrating a usable measuring duration of three minutes, measured with an ICR cell as shown in FIG. 10 in a magnetic field of seven tesla. The monoisotopic ions were isolated outside the ICR cell and then introduced.

Figure 13:
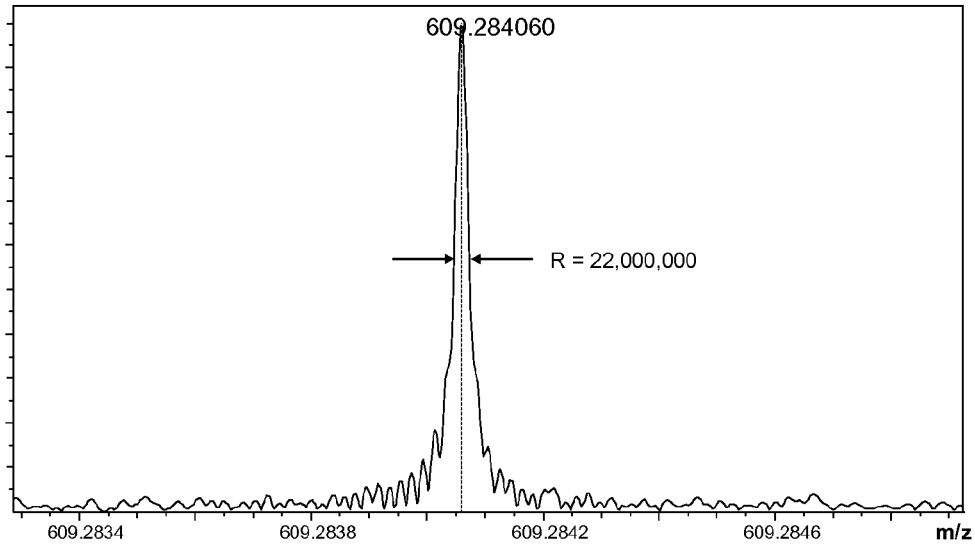

FIG. 13 presents the peak of the monoisotopic reserpin ions, showing a mass resolution of 22 millions in the magnetic field of seven tesla only. The peak was achieved by Fourier transformation of the transient shown in FIG. 12, after apodisation with a Gaussian curve. Peak symmetry is excellent.

FIG. 14 shows the fine structure of the $(M+2)^{++}$ peak of substance P ($C_{63}H_{100}N_{18}O_{13}S_1$), calculated from transients with 70 seconds in length, measured in a magnetic field of seven tesla. The upper part presents the simulated, the lower part the measured fine structure. The mass resolution amounts to R=6,000,000.

FIG. 15 indicates, how an ICR cell according to this invention can be prolonged by parabolic gaps which cross each other. Trapping voltages V and 2×V must be applied to the sheath electrodes.

FIG. 16 exhibits the Orbitrap®, an electrostatic state-of-the-art Kingdon cell in which the cyclic motion of the ions around the inner electrode is completely decoupled from the harmonic oscillation in axial direction. The oscillation in axial direction is measured by image currents and used for mass determination.

FIG. 17 shows an electrostatic Kingdon ion trap of the oscillational type with two spindle-shaped inner electrodes in a three-dimensional representation. The ions oscillate in the Kingdon ion trap in the plane between the two inner electrodes and execute harmonic oscillations in the axial direction. This Kingdon ion trap also corresponds to the prior art.

PREFERRED EMBODIMENTS

A first embodiment of the invention is, as an example, based upon a cylinder made from glass, the sheath surface of which is cut, in longitudinal direction, into four rectangular quarters, as in the conventional ICR cell of FIG. 1. As shown in the upper part of FIG. 5, the quarters, however, are covered with layers of resistive material (09) in such a way that a parabolic potential profile, as shown in the lower part of FIG. 5, can be generated by a trapping voltage. Semiconductors as well as metals like tungsten may serve as resistance materials. The resistance should be high, the ICR cell should not be heated above acceptable levels in the ultrahigh vacuum.

A glass cylinder with about 60 millimeter internal diameter and about 150 millimeter length can, for instance, be produced including the central contacts by a method called "KPG" (calibrated precision glass). KPG is a method developed by Schott Geräte GmbH. It is a hot replica technique, wherein an evacuated glass cylinder, heated up almost to the melting point, is pressed by the outer gas pressure against a suitable metallic precision core. During cooling, the core contracts more than the glass, and the core can be removed after cooling.

The layer can be brought onto the electrodes by a variety of methods, e.g. by evaporation. A varying thickness of the resistive layer, as indicated in FIG. 5, can be produced already by the evaporation process. A more favorable process, however, corrects the resistance profile by laser trimming; either correcting the thickness of the layer by laser ablation, or by cutting a multitude of groves into the layer, as can be seen in FIG. 6. Such a laser trimming can be performed, as is widely known, by feedback control measuring the resistance.

If the quarters are covered with semiconductor material, the wanted resistance profile can be achieved by ion doping which can alter the resistance easily by many orders of magnitude. Ion implantation in vacuum is one of the methods which can be applied here.

The quarters with resistive layers can be composed, together with endcap electrodes, to form the ICR cell, as shown in the upper part of FIG. 5. The endcap electrodes (01) and (07) ideally should have the shape of rotational hyperboles, exactly following the equipotential surfaces of the wanted harmonic three-dimensional quadrupole field; their shape can be, however, be approximated by a sphere. The apertures (08) serve to introduce the ions axially along the magnetic field lines. The specialist in the field knows the form of the rotational hyperboles and their calculation from the shape of the endcaps of three-dimensional RF ion traps invented by Nobel-laureate Wolfgang Paul.

Between the central connections, reaching through the glass, and the outer connections at the ends, a single trapping voltage can be applied. The endcap electrodes are connected to the same trapping potential as the ends of the sheath electrodes. There is only one single trapping voltage; the adjustment of this voltage, usually between one and tree volts, is greatly uncritical. The DC trapping voltage keeps the cloud of ions together in longitudinal direction; a favorable adjustment of the DC trapping voltage produces a length of this cloud of about six to eight centimeters.

An AC voltage pulse, either a chirp or a synch pulse, excites ions of all masses to their cyclotron motion. The pulse is simply fed to the resistive layers of two opposing sheath electrodes. Because of the length of the ICR cell, an extended dipole field generated, equally exciting all ions of the extended central cloud. The image currents of the orbiting ions can be measured by the two remaining sheath electrodes, connecting the central contacts with the image current amplifier.

If the dipolar field of the AC voltage pulse does not uniformly cover the full length of the ion cloud, endcaps in the form of those used in the infinity cell (FIG. 4) can be provided here, too. The effect of these endcaps, divided into partial electrodes, was described above. A dipolar field is generated inside the ICR cell which reaches uniformly into the very near vicinity of the endcaps. With these infinity cell endcaps, which still may be formed rotationally hyperbolic, also the AC dipolar excitation field fills the whole ICR cell in an almost ideal way.

Design and operation of this first embodiment can be varied in a variety of ways. Instead of the glass cylinder, a cylinder made from ceramics or even from metal may be used. Using metal cylinder electrodes, the resistive layer has to be isolated from the metal by an isolating layer.

Instead of the four longitudinal electrodes, also eight or more such sheath electrodes may be applied. This enables a measurement of the image currents with four or more electrodes, doubling or multiplying the cyclotron frequency. This allows for shorter measurements to achieve the same high mass resolution.

A second, principally different embodiment of the invention uses eight sheath electrodes, of which only four sheath electrodes carry the resistive layer, whereas the remaining electrodes are well conducting. In FIG. 7, the alternating arrangement of electrodes (20) to (23) with resistive layers and electrodes (24) to (27) without such layers is shown as a cross section through such an ICR cell. The conducting electrodes, e.g. made from well-conducting metal, may be used for the measurement of the image currents. These measurements are particularly critical; they should be performed by electrodes not connected to any resistance, because resistances easily catch up or even generate electronic noise. The endcap electrodes then should be applied with half the trapping potential; with segmented endcap electrodes, special potential profiles from the center to the outer sections may be generated adapted better to the internal potential distribution. There are two operation modes: detection with four metallic electrodes, whereby the excitation uses the resistive electrodes, or detection with two metallic electrodes only, using the other two for the excitation of the ions.

This second embodiment of an ICR cell with intermixed resistive and well conducting electrodes is basically different from the first embodiment; it no longer exhibits a fully harmonic static potential distribution. The internal potential distribution is now very complex and no longer rotationally symmetric. Orbiting ions, however, experience along their cyclotron paths averaged potential distributions which are completely harmonic. The three-dimensionally quadrupolar potential distributions, experienced by the ions, allow them to oscillate in axial direction with ion-specific frequencies, fully independent of their orbiting radius and oscillation amplitude. These potential distributions, averaged over cyclotron orbits, are again ideal and reach up to the walls of the ICR cell in any direction. Also this second embodiment of the ICR cell according to the invention solves the dilemma between ideal potential distribution and excitation by extended electrodes.

Further design variations of this second embodiment use more (or less) than eight longitudinal sheath electrodes. More sheath electrodes enable the user to measure the image current at still higher frequencies, as far as shape and dispersion of the ion clouds do allow for this. Other variations may use longitudinal sheath electrodes which vary in width, whereby the resistance profiles of the resistive layers have to be adapted to these forms of the electrodes to generate the wanted potential distribution.

A particularly preferred third embodiment of an ICR cell according to this invention consists in a cylindrical ICR measuring cells whose cylindrical surface is split longitudinally by parabolically formed separation gaps into longitudinal sheath electrodes, as seen in FIG. 8. The sheath electrodes thus have widths varying in longitudinal direction. This third embodiment of the ICR cell is basically different from first and second embodiment in so far, as it does not require any resistive layers on the sheath electrodes to generate a potential distribution which, on average over any ion orbit, will be experienced by orbiting ions as an ideal harmonic field. As depicted in FIG. 8, the parabolic separating gaps result in digonal and triangular (trigonal) sheath electrodes with curved sides. If a trapping potential is applied to all the triangular sheath electrodes thus created (and to the endcap electrodes), a complicated potential distribution is created in the interior of the measuring cell, which, for orbiting ions, again looks like a harmonic potential distribution throughout the whole cell.

A "digon" (adjective: "digonal") is defined as a surface section with two corners, in most cases on non-planar surfaces, but here used in combination with curved sides also for plane or cylindrical surfaces. The digon is a polygon with only two corners. Correspondingly, a "trigon" is a triangular surface section (where the term "trigonometry" comes from), an a "tetragon" is a four-cornered surface section.

Also this third preferred embodiment of an ICR measuring cell according to this invention may favorably be closed, as depicted in FIG. 8, at both ends by endcap electrodes (01). The endcap electrodes are connected to the trapping DC voltage already applied to the triangular electrodes. Also in this embodiment the endcap electrodes (01) ideally have, as is common for three-dimensional ion traps, a rotationally hyperbolic form with a full angle of $2\sqrt{2}$ of the cone approximating the hyperbole. In practice, however, the rotational hyperbole might be simply approximated by a sphere; according to our experience, the tiny deviation does not influence the results. Apertures (08) allow for the introduction of ions along the magnetic field lines; the specialist in the field knows how to fill this cell with ions. The cylinder sheath of this cylindrical cell is cut by the parabolic slits into a total of 24 electrodes.

FIG. 9 exhibits, in the upper part, the unrolled form of the digonal and trigonal sheath electrodes. As can be seen in the lower part of FIG. 9, the ICR cell generates a potential distribution, which, averaged over any ion orbit, presents an ideal harmonic potential distribution with parabolic potential profiles in axial and in radial directions.

In FIG. 10, a slight design change of the third embodiment generates a still more favorable ICR cell. The digonal electrodes, e.g. (36), are somewhat narrower, so that the former triangular electrodes combine in the center to tetragonal electrodes with slender waists (35), (37), reaching from one end of the ICR cell to the other. Furthermore, four of the eight digon-shaped central electrodes generated by the parabolic gaps are cut by straight gaps (30) and (31), so that the sheath electrodes can be grouped into four exact cylinder quarters, each quarter tightly covered with electrodes. For example, the electrodes (34) to (38) form such a quarter. As shown in FIG. 11 with electrodes unrolled into a plane, the electrodes of two opposite quarters can be used to excite the ions homogeneously to cyclotron motions; and the digonal electrodes of the other two quarters will serve to measure the image currents.

This third embodiment of the ICR cell can also be equipped with endcaps of the infinity-cell kind to prolong the uniformity of the dipolar AC excitation field.

All embodiments of the ICR cell according to this invention are easy to operate because they require, for optimum performance with highest mass resolution, only a single trapping DC voltage of about one to two volts, as can be seen in the wiring example of FIG. 11. Furthermore, this DC trapping voltage is relatively uncritical. This is quite in contrast to the "ICR compensation cells" of the prior art shown in FIG. 2 which up to now gave the best results, but need a thoroughly tuned set of at least three very critical DC trapping voltages. This tuning for the "ICR compensation cell" is an extremely difficult task and can, as a rule, only performed by help of computer simulations to find a first approximation to an ideal harmonic potential around the center, and further adjustments to achieve the transients of maximum usable lengths.

The most preferred third embodiment of the ICR measuring cell according to this invention in the precise form shown in FIG. 10 exhibits outstanding performance. The clouds of ions can be excited to their cyclotron motion up to radii very near to the electrodes, thus achieving extraordinarily high sensitivity. The usable duration of image current transients is prolonged from second to minutes, achieving sensational mass resolution. The reason for this is not quite clear, it may be the result of the ideal potential distribution, but there may even be a "coherence focusing" for the clouds of ions by the strangely formed field.

To explain this hypothesis of "coherence focusing", let us have a closer look into the situation inside such a measuring cell. A favorable cell, formed as in FIG. 10, has an internal diameter of six centimeters, and a length of the cylinder of 15 centimeters. The cloud of ions introduced into the cell takes the form of a axial spindle in which ions oscillate in axial direction with their individual trapping oscillation frequencies according to their masses. The oscillation amplitude is not uniform but shows a spread: More energetic ions oscillate wider, less energetic ions narrower. After introduction of the ions, the ion cloud in form of the spindle is located in the axis of the cell. The spindle may have a diameter of about one to three millimeters, and a length of about six to ten centimeters, thus having a volume of a few hundred microliters. If this volume is filled with about 100,000 ions, the particle density of the ions is about that of the residual gas with a pressure of roughly $10^{-8}$ pascal. The mean free path length is about 1000 kilometers, so the cloud of ions is by no means dense, it is, in contrast, quite empty.

However, the particles of the cloud are not neutral and the ions of the spindle form a space charge distribution affecting all ions within the spindle. In radial direction, the force of the space charge is directed radially to the outside, pushing the ions away from the center of the spindle. It is well-known, however, that pushing in a direction transverse to a magnetic field means that the particle evades in a direction rectangular to the pushing direction. This pushing force has the effect that the ions rotate around the axis of the spindle: the spindle gyrates without any enlargement of its diameter. The gyrating speed depends on the space charge and the mass m/z of the ions, and is governed by a balance between centrifugal force of the space charge plus the (tiny) centrifugal force of the rotating ion on one hand, and the Lorentz force in centripetal direction on the other. In axial direction, the effect of the space charge is not stopped in any way and may lengthen the spindle of ions a little.

After excitation to ion cyclotron orbits, as many such spindles exist as there are different types of ions with different masses m/z. Each spindle orbits around the center of the cell and gyrates around its own axis. On their orbit, the ions of the spindle encounter numerous local potential changes, built up by the different potentials of the sheath electrodes, and it may well be that these potential changes with additional forces onto the spindles refocuses the spindle to a circular cross section as soon as deviations show up from this ideal form. A similar effect is known in ICR mass spectrometry as "peak coalescence", described in the prior art part, where ion clouds of slightly different ion masses, passing each other slowly on their orbit, start to gyrate around each other and are combined, by the effect of the space charge, to a single ion cloud, no longer showing up the different types of ions. Thus the "coherence focusing" may be assumed to be a kind of permanent peak coalescence of a single ion cloud. In a general sense, an ICR cell according to this invention can be described as being equipped with electrodes creating an electric potential inside the cell, wherein the electric potential averaged along a circular orbit is harmonic and exhibits varying radial forces along the circular orbit.

To demonstrate the performance of the ICR cell according to this invention, some results are presented. In FIG. 12, the image current transient for the isolated monoisotopic ions of reserpin is presented, measured by the most preferred third embodiment of the ICR cell depicted in FIG. 10, demonstrating a usable measuring duration of three minutes (by far not the limit). After Fourier transformation with apodisation by a Gaussian curve, this long transient resulted in a peak with a mass resolution of 22 millions, as shown in FIG. 13. This value of resolution, obtained in a magnetic field of seven tesla only, has never been achieved hitherto by any ICR mass spectrometer.

Of course, mass spectrometry with a single mass peak is not useful at all. With simple mixtures of ions, this cell stably shows resolutions between five million and ten million, with complex mixtures, resolutions safely above one million, using transients with durations of one to two minutes. This is outstanding.

Particularly interesting is the measurement of the fine structure of the second $^{13}C$-satellite $(M+2)^+$ or $(M+2)^+$ of heavy organic substances M of unknown composition. The fine structure signal contains peaks not only from ions with two $^{13}C$ atoms instead of two $^{12}C$ atoms, but also peaks from ions with $^{18}O$ instead of $^{16}O$, $^{34}S$ instead of $^{32}S$, $^{13}C^{15}N$ instead of $^{12}C^{14}N$, $^{2}D$ instead of $^{1}H_2$, and so on. The measurement of such a fine structure makes it easy to determine numbers and kinds of all hetero elements involved (except phosphor, which, however, can be determined by precise mass determination of this compound), an analysis hard to perform using any other method for heavy ions. In FIG. 14, the fine structure of the $(M+2)^{++}$ ion signal of substance P is presented, together with the simulated fine structure, demonstrating a mass resolution of R=6,000,000, obtained from a transient measured over 70 seconds in a magnetic field of seven tesla only.

This new cell has proved to be mechanically and operationally stable. Because the sheath electrodes reach from one end of the cylinder to the other, they can easily be mounted on two rings made from machinable glass (macor) or ceramics, not using any plastics inside the vacuum chamber. By using special ultrahigh-vacuum resistors and capacitors inside the vacuum, it needs only a few electrical feedthroughs. So the vacuum-technical properties are excellent.

First experiences with the new ICR cell according to the third embodiment do not only show excellent values for mass resolution, but also much better behavior with respect to mass accuracy and reproducibility of signal intensities relative to each other. Experiments with mixtures of well-known substances can be performed, using some of the ion signals as internal mass references, and determining the precise masses of the others. If these experiments are performed with increasing amounts of ions in the cell, covering a range of 1:250 in ion numbers loaded into the cell, the measurements for the masses of some ions show a shift, some ions to higher masses, some ions to lower. These shifts are caused by the increasing space charge and amount to about plus or minus three to ten parts per million of the mass in the best mass spectrometers of prior art, forcing the user to thoroughly control the ion load. In preliminary experiments with the new cell, the shift almost completely vanished, giving rise to expectation that the performance with respect to mass accuracy is similarly better. The new cell seems to have the power to start a new era in ICR mass spectrometry, with mass resolutions and mass accuracies more than tenfold better than hitherto.

Since the ions of the individual masses are coherently kept together in spindle-shaped clouds on their orbits for long periods, it is possible to measure double, or a multiple of, the orbital frequencies by using four or more image current measuring electrodes without the image current transients thus obtained quickly decreasing to residual noise. A specified resolving power can thus be achieved in half the measuring time or less. The gaps in the cylindrical surface can be designed so that not only four, but eight, twelve or more digon-shaped sheath electrodes are formed. With eight digonal sheath electrodes, as in FIGS. 8 and 10, two (or even four)

of them can be used to excite the ions to cyclotron orbits, for example, and the other four to measure the image currents with a frequency which corresponds to twice the orbital frequency.

It may even be possible to intermediately connect all eight digon-shaped electrodes with the image current amplifier by switches to measure the image currents. The switches, however, have to have extremely low resistances and should not show any contact voltages; switching can neither be done by electronic switching nor by mechanical relays. Mercury switches may fulfill the requirements but were too slow for being used in the past. But with transients which last for minutes, such switching may become possible.

If the separating gaps are parabolic, suitable voltages applied to the triangular (or slender-waisted tetragonal) sheath electrodes and the endcaps generate a potential distribution in the interior of the cylinder which is parabolic in the direction of the axis for orbiting ions. The parabolic profile is exactly the same for ions on orbits of all radii and reaches up to the endcap electrodes; orbiting ions of the same mass thus oscillate in the axial direction with the same trapping frequency irrespective of their orbiting radius and their oscillation amplitude. The cyclotron frequency is most probably independent of the trapping frequency, at least, the influence of the trapping frequency becomes completely invisible by a good calibration.

The invention also provides methods for the acquisition of mass spectra with very high mass resolution in the ICR measuring cells. In particular, the single trapping voltage can be optimized so that the usable portion of the transients becomes as long as possible. A fully automatic optimization method can be programmed with a computer-based evaluation. Because the influence of space charge seems to be lower than with ICR cells according to the state of the art, it appears to be possible that the ICR instrument then can be operated with a fixed optimum trapping voltage, once optimized during production in the factory.

The introduction of the ions into the measuring cell may follow conventional methods, preferably with low trapping voltages applied only to the endcap electrodes. This leads to an axially extended cloud of ions with a diameter in the order of one to three millimeters in the axis of the measuring cell. The ions oscillate in this cloud from one end of the cell to the other and back again. After the capture of the ions, the trapping voltages are also applied to the sheath electrodes; thereby reducing the length of the cloud of ions. The ions still oscillate to and fro inside the cloud in axial direction with amplitudes depending on their individual kinetic energies.

The excitation of this ion cloud, by raising the ions to cyclotron orbits by a chirp, for example, requires a longitudinally extended, uniform electric excitation field in order that all ions can be uniformly affected to the same extent. This axially extended field can be already provided for all embodiments of ICR cells according to this invention by their length. If the uniformity of the excitation field in axial direction is not sufficiently good, endcaps may be provided which are divided into partial electrodes in the manner of the infinity cell in FIG. 4.

The cylindrical shape of the ICR cell is particularly favored here (a) because an ideally homogeneous excitation field can only be generated within a cylinder, (b) because the ions move with their orbiting and oscillating movements on circular cylinder surfaces and are best measured by cylindrical measurement electrodes and (c) by best utilizing the magnetic field of the rather expensive superconducting magnets. The cylinders of the ICR cell may be circular, but other shapes like square cylinders or cylinders with polygonal basis may be used, too. Even slight deviations of the cylindrical ICR cells towards barrel or cushion-like forms may be still acceptable.

Because these new ICR cells exhibit fully harmonic electric trapping fields, they may not only be used to measure the cyclotron frequencies of the ion clouds. The ICR cells offer nicely parabolic wells in axial direction. The ion clouds may, after increasing the trapping voltage, be excited to oscillations in the axial direction, and the image currents of these oscillations, measured at suitable electrodes, may be used to determine the masses of the ions. The measurement of axial oscillations is similar to the operation of certain types of electrostatic Kingdon ion traps as mass spectrometers.

In principle, all types of embodiments described above may be used for the oscillation measurements, but most favorable are here, too, the embodiments according to FIGS. 8 and 10. If ions are filled into the ICR cell according to FIG. 8 in the usual way, the ions may be first excited to cyclotron motions by a dipolar excitation voltage pulse in form of a chirp. The trapping voltage is then increased to some kilovolts, thereby squeezing the slender ellipsoidal ion clouds almost to spheres, orbiting in the center plane of the ICR cell. There are now several methods for the excitation in axial direction and the measurement of the image currents. For instance, the spheric clouds may be excited by an excitation chirp at the endcaps to their axial oscillations, while still cycling on their cyclotron orbits, and the image currents may be measured by the triangular sheath electrodes. The oscillation frequency depends on the trapping voltage. It is favorable to choose, by adjustment of the trapping voltage, an oscillation frequency which is quite different from the cyclotron frequency, e.g., a tenth of the cyclotron frequency for a given mass.

In an ICR cell according to FIG. 10, either the endcap electrodes or the tetragonal electrodes or both may be used to measure the axial oscillations. With the tetragonal electrodes, automatically the doubled oscillation frequency is measured.

If a very slender ICR cell of small diameter is used, the ion clouds don't need to be excited to cyclotron motions. The ion clouds located in the axis may be directly excited to axial oscillations. Because the magnetic field is only used to keep the ion clouds in the axis, a permanent magnetic field may be used.

This type of oscillation measurement is advantageous, compared with cyclotron measurements, for ions of heavy masses in the range beyond m/z=2000 Dalton, because the mass resolution for these oscillation measurements drops favorably only reciprocally with the root of ion mass $1/\sqrt{(m/z)}$, instead of the sharper decrease of the mass resolution with reciprocal mass z/m in the case of ICR.

With knowledge of this invention, those skilled in the art will be able to develop further advantageous measuring methods using corresponding ICR measuring cells. For instance, the potentials on the slender-waist tetragonal sheath electrodes do not need all to be the same, possibly in order to generate special focusing effects on the ion clouds. These potentials can also be adjusted by the optimization procedure for very high mass resolutions. Furthermore, the ultrahigh performance of the new types of ICR cells makes it possible to design useful ICR instruments with permanent magnets of much lower magnetic field strengths. The development of further types of ICR measuring cells is also possible. An example is given in FIG. 15, where a prolonged ICR cell is shown with crossovers of the parabolic gaps.

The invention claimed is:

1. An ICR cell in the form of a cylinder whose cylindrical surface is separated by longitudinal gaps into a multitude of sheath electrodes, wherein some or all of the sheath electrodes either comprise resistance profiles being configured to create a harmonic potential increase from the center to both ends of the some or all sheath electrodes, or vary in width by virtue of parabolic separating gaps such that the potential averaged over a cyclotron orbit is harmonic in the direction of the cell axis within the cell.

2. The ICR cell according to claim 1, wherein resistance profiles of parabolic shape or the parabolic gaps are arranged symmetrically along the ICR cell, with the parabola summits in the middle plane.

3. The ICR cell according to claim 1, wherein end cap electrodes are present at both ends of the ICR cell divided into partial electrodes by gaps whose forms follow selected equipotential surfaces of a dipolar excitation field generated between sheath electrodes.

4. The ICR cell according to claim 1, wherein end caps having rotationally hyperbolic or spheric shape are present at both ends of the ICR cell.

5. The ICR cell according to claim 3 or claim 4, wherein a trapping voltage is applied to the end cap electrodes and to the sheath electrodes with resistance profiles or with varying width, thereby generating, at least as an average for orbiting ions, a harmonic trapping field inside the ICR cell, reaching in all directions up to the walls of the ICR cell.

6. ICR cell according to claim 1, wherein some or all longitudinal sheath electrodes take the form of digonal and triangular or waisted tetragonal electrodes, generated by the separating parabolic gaps between the sheath electrodes.

7. The ICR cell according to claim 6, wherein four, eight, twelve or sixteen digonal sheath electrodes are present.

8. The ICR cell according to claim 7, wherein a multitude of sheath electrodes are connected to an image current measuring amplifier in such a way that frequencies in the image currents correspond to a multiple of the ion cyclotron frequency.

9. The ICR cell according to claim 1, wherein a magnetic field for ICR operation is provided by a permanent magnet.

10. An ICR cell with electrodes configured to create an electric potential inside the cell, wherein the electric potential averaged over a cyclotron orbit is harmonic in the direction of the cell axis and the electric potential exhibits varying radial forces along the cyclotron orbit.

11. A method for the measurement of mass spectra using an ICR cell in the form of a cylinder whose cylindrical surface is separated by longitudinal gaps into a multitude of sheath electrodes, wherein some or all of the sheath electrodes either comprise resistance profiles being configured to create a harmonic potential increase from the center to both ends of the some or all sheath electrodes, or vary in width by virtue of parabolic separating gaps such that the potential averaged over a cyclotron orbit is harmonic in the direction of the cell axis within the cell, wherein ion clouds are excited to perform cyclotron motions, and image currents of the cyclotron motions are used to determine the masses of the ions.

12. The method according to claim 11, wherein the image currents of cycling ion clouds are measured at four, six or eight sheath electrodes so that the ion clouds produce image current frequencies which correspond to twice, three times or four times the cyclotron frequency.

13. A method for the measurement of mass spectra using an ICR cell in the form of a cylinder whose cylindrical surface is separated by longitudinal gaps into a multitude of sheath electrodes, wherein some or all of the sheath electrodes either comprise resistance profiles being configured to create a harmonic potential increase from the center to both ends of the some or all sheath electrodes, or vary in width by virtue of parabolic separating gaps such that the potential averaged over a cyclotron orbit is harmonic in the direction of the cell axis within the cell, wherein ion clouds are excited axially to perform axial oscillations, and image currents of the axial oscillations are used to determine the masses of the ions.

14. The method according to claim 13, wherein the ions are excited to cyclotron motions before they are excited in axial direction.

15. The method for the measurement of mass spectra using an ICR cell according to claim 11 or claim 13, wherein a trapping voltage is adjusted to produce the longest possible useful transient.

* * * * *